US007407152B2

(12) United States Patent
Platt

(10) Patent No.: US 7,407,152 B2
(45) Date of Patent: Aug. 5, 2008

(54) FENCING SYSTEM AND POST INSERT FOR USE THEREWITH

(76) Inventor: Robert E. Platt, 8701 Highland Ave., Mineral Ridge, OH (US) 44440

( * ) Notice: Subject to any disclaimer, the term of this patent is extended or adjusted under 35 U.S.C. 154(b) by 123 days.

(21) Appl. No.: 11/046,499

(22) Filed: Jan. 28, 2005

(65) Prior Publication Data

US 2006/0169966 A1 Aug. 3, 2006

(51) Int. Cl.
*E04H 17/00* (2006.01)

(52) U.S. Cl. ..... 256/65.03; 256/65.01; 256/65.02; 256/65.04

(58) Field of Classification Search ..... 256/59, 256/65.01, 65.02, 65.03, 65.04, 65.05, 65.14; 52/296

See application file for complete search history.

(56) References Cited

U.S. PATENT DOCUMENTS

| | | | | |
|---|---|---|---|---|
| 3,241,279 | A | 3/1966 | Balley | |
| 3,256,659 | A | 6/1966 | Dudoff | |
| 3,463,456 | A * | 8/1969 | Walker | 256/22 |
| 3,993,289 | A * | 11/1976 | Lewis et al. | 256/59 |
| 4,104,000 | A | 8/1978 | Fleischmann | |
| 4,809,955 | A | 3/1989 | Veilleux | |
| 5,022,618 | A | 6/1991 | Barrett et al. | |
| 5,335,471 | A | 8/1994 | Kupiec | |
| 5,755,431 | A * | 5/1998 | Williams | 256/19 |
| 6,098,353 | A | 8/2000 | Stanfield | |
| 6,141,928 | A | 11/2000 | Platt | |
| 6,213,452 | B1 | 4/2001 | Pettit et al. | |
| 6,290,212 | B1 | 9/2001 | Bartel | |
| 6,305,670 | B1 * | 10/2001 | Ward et al. | 256/59 |
| 6,467,756 | B1 * | 10/2002 | Elsasser | 256/65.14 |
| 6,508,457 | B1 | 1/2003 | Knudson et al. | |
| 6,718,710 | B2 | 4/2004 | Platt | |
| 2003/0221385 | A1 * | 12/2003 | Platt | 52/296 |
| 2004/0026679 | A1 * | 2/2004 | Terrels et al. | 256/65.03 |
| 2004/0056241 | A1 * | 3/2004 | Calverley | 256/65.02 |
| 2005/0127346 | A1 * | 6/2005 | Steffes | 256/65.05 |
| 2006/0022188 | A1 * | 2/2006 | Collins | 256/65.14 |
| 2006/0065885 | A1 * | 3/2006 | Stanley | 256/59 |

* cited by examiner

*Primary Examiner*—Daniel P. Stodola
*Assistant Examiner*—Daniel J. Mills
(74) *Attorney, Agent, or Firm*—Sand & Sebolt

(57) ABSTRACT

A fencing system includes a post mount mountable on a foundation and having a vertically extending outer surface. A post insert sits atop the post mount and has an outer surface disposed outwardly of the post mount outer surface. The post insert has an upper sidewall which extends upwardly of the post mount and defines an upwardly opening cavity. A post includes a sidewall having an inner surface defining a cavity therein in which the post mount and post insert are slidably received with the outer surface of the post insert preferably closely adjacent the post inner surface. A rail is mounted via a rail mounting bracket to the post insert. Threaded fasteners extend from the rail mounting bracket through respective holes in the post and are threaded into mounting holes in the post insert to provide a strong connection for the mounting of the rail mounting bracket and rail.

32 Claims, 4 Drawing Sheets

FENCING SYSTEM AND POST INSERT FOR USE THEREWITH

BACKGROUND OF THE INVENTION

1. Technical Field

The invention relates generally to a fencing system or railing system. More particularly, the invention relates to a fencing system having a post support which provides sturdy mounting of the railing structure. Specifically, the invention relates to such a post support having a post insert mounted atop a post mount with the railing structure secured to the post insert.

2. Background Information

Fencing and railing systems commonly utilize vertically mounted post structures with horizontal railing structures extending between and mounted on adjacent post structures. It is known in the art to utilize a post mount which is mounted on the ground or to a floor structure of some sort with the post mount slidably received within a hollow post whereby various types of structure attached to the post mount engages the inner surface of the post in order to provide support to the post. The various structure mounted on the post mount to help support the post either is disposed closely adjacent the inner surface of the post or in contact with said inner surface. One example of such a configuration is disclosed in U.S. Pat. No. 6,141,928 granted to the Applicant. Said patent discloses a post mount having fins or other outwardly projecting structure formed integrally therewith which frictionally engage the inner surface of the post to provide support thereto. Another example is disclosed in U.S. Pat. No. 6,718,710 granted to the Applicant. Said patent discloses a post mount having a head seated atop the post mount with a plurality of tabs extending outwardly therefrom which frictionally engage the inner surface of the post to provide support thereto. Both of said patents are incorporated herein by reference. Other post mounts are known in the arts which have somewhat similar structures.

While these patents and other structures provide suitable support to the post for many purposes, there remains a need in the art for a connection between the railing structure and the post structures whereby said connection is substantially sturdier than those presently known. Most typically, the railing structures are secured by a fastener typically in the form of a screw or bolt to the post itself. Especially for railing structures that are elevated substantially above the ground or floor to which the post mount is attached, such a connection is not as sturdy as desired for certain applications.

BRIEF SUMMARY OF THE INVENTION

The present invention provides a fencing system comprising a post mount having an upper end, a lower end and an outer surface extending therebetween; the post mount being adapted to be mounted adjacent the lower end thereof to a foundation; a post insert having an upper end, a lower end and an outer surface which extends therebetween wherein a portion of the outer surface of the post insert is disposed outwardly of the outer surface of the post mount; the post insert being mounted on the post mount adjacent the upper end of the post mount; a structural member defining a cavity in an end thereof; the post mount and post insert being slidably received in the cavity of the structural member; and a rail structure secured to the post.

BRIEF DESCRIPTION OF THE SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numbers refer to similar parts throughout the specification.

DETAILED DESCRIPTION OF THE INVENTION

Figure 1:
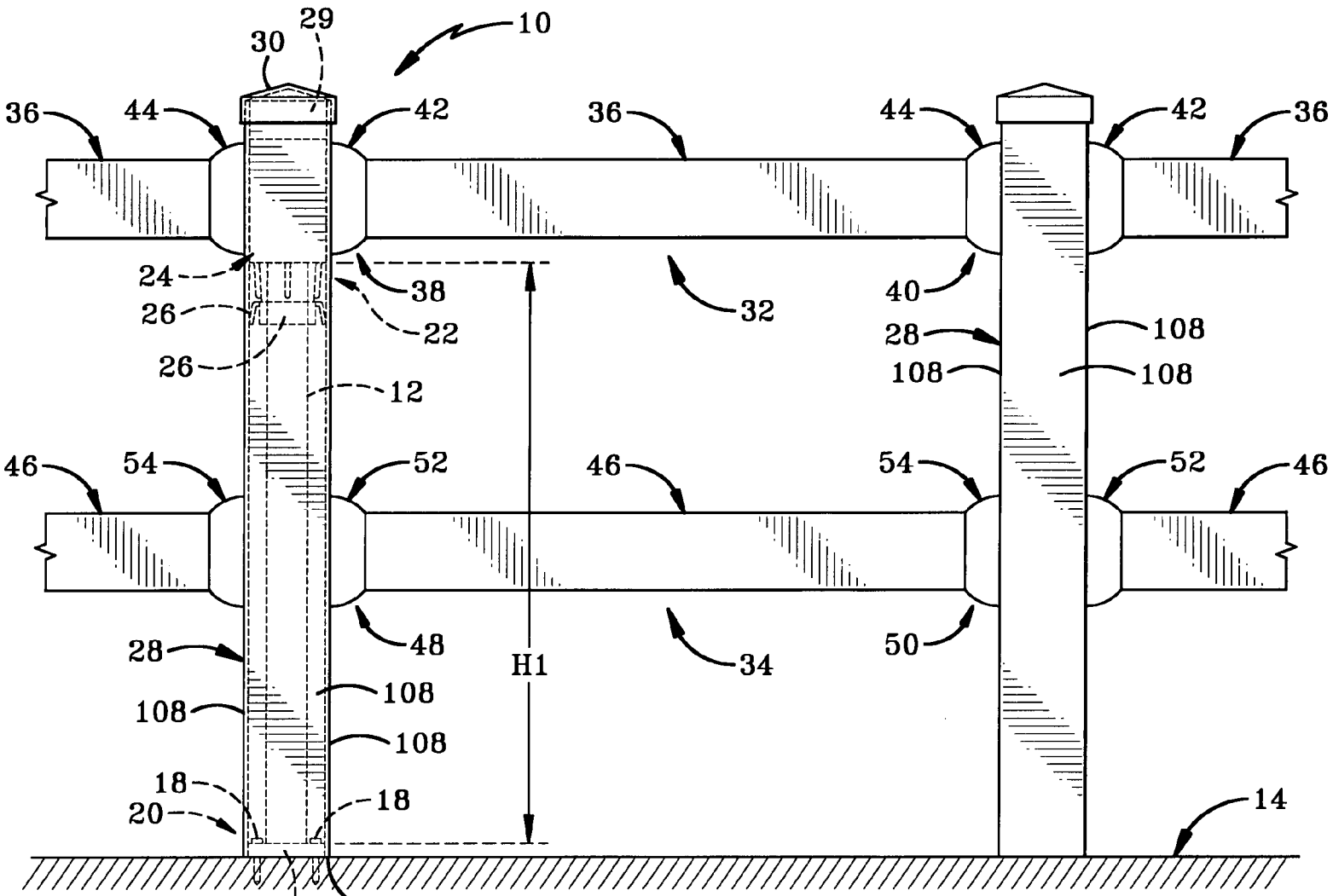
FIG. 1 is an elevational view showing the fence system of the present invention with the posts and railing structures in solid lines and the post mount, post insert and related structure in dashed lines.

The fencing system of the present invention is indicated generally at 10 in FIG. 1. System 10 includes a post mount 12 which is mounted on a foundation or base structure 14 such as a floorboard of a floor or platform, a concrete floor or the like or the ground itself. Post mount 12 is typically mounted on a plate 16 adjacent a lower end 20 thereof by welding, for example, and mounted via plate 16 to base structure 14 via bolts 18 or other suitable fasteners known in the art. Some examples of mounting structures for mounting a post mount are described in more detail in the above-referenced patents granted to the Applicant. Post mount 12 has an upper end 22 and is elongated between lower and upper ends 20 and 22, having a height H1 extending from upper end 20 to lower end 22.

In accordance with a feature of the invention and with continued reference to FIG. 1, system 10 includes a post insert 24 mounted atop post mount 12 adjacent upper end 22 thereof and distal lower end 20, as will be further detailed below. System 10 may also include outward projections 26 which extend outwardly from post mount 12. System 10 further includes a hollow post 28 having an upper end 29 and a lower end 31 which slides over post insert 24, projections 26, post mount 12 and plate 16. System 10 may include a cap member 30 seated atop post 28. System 10 includes an upper rail structure 32 and a lower rail structure 34 each mounted between a pair of adjacent posts 28. Upper rail structure 32 includes a rail 36 having a first end 38 and a second end 40 opposed thereto with rail 36 being elongated there between. Upper rail structure 32 further includes a rail mounting bracket 42 mounted on each post 28 as necessary to support rail 36 adjacent first end 38 thereof. Another rail mounting bracket 44 is mounted on each post 28 whereby the bracket 44 mounted on an adjacent post 28 supports rail 36 adjacent second end 40 thereof.

Lower rail structure 34 likewise includes a rail 46 having a first end 48 and the second end 50 opposed thereto and being elongated between ends 48 and 50. Lower rail structure 34 also includes a rail mounting bracket 52 mounted on each post 28 for supporting rail 46 adjacent first end 48 thereof. Another rail mounting bracket 54 is mounted on each post 28 opposite a respective rail mounting bracket 52 whereby each rail mounting bracket 54 supports one of rails 46 adjacent respective second end 50 thereof. Lower rail structure 34 is mounted in a conventional manner to a pair of adjacent posts 28.

Figure 2:
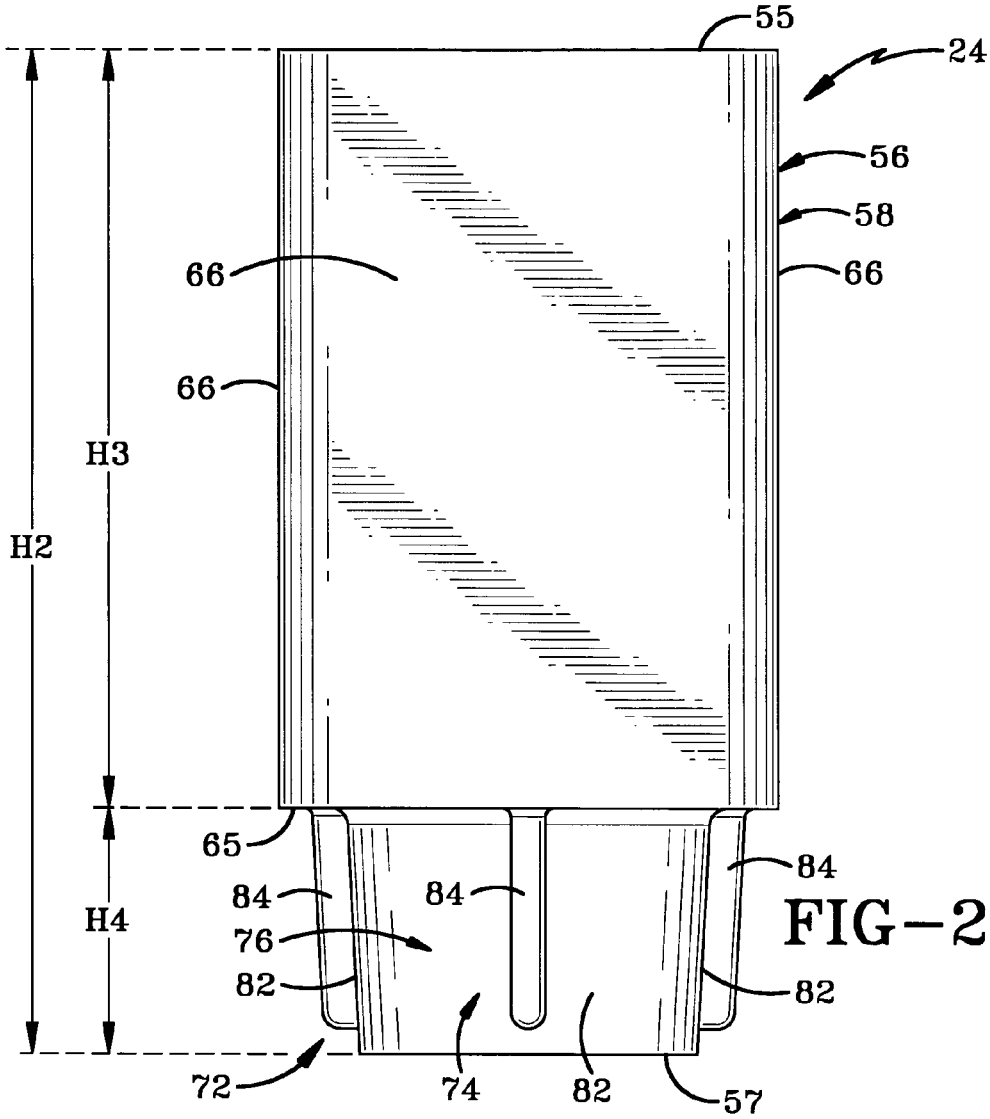
FIG. 2 is an elevational view of a first embodiment of the post insert of the present invention.
Figure 3:
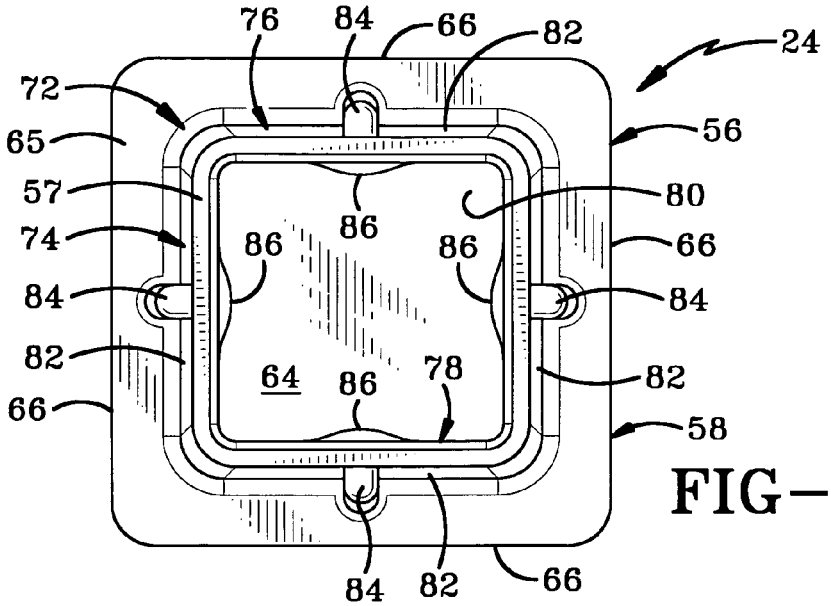
FIG. 3 is a bottom plan view of the first embodiment of the post insert shown in FIG. 2.
Figure 4:
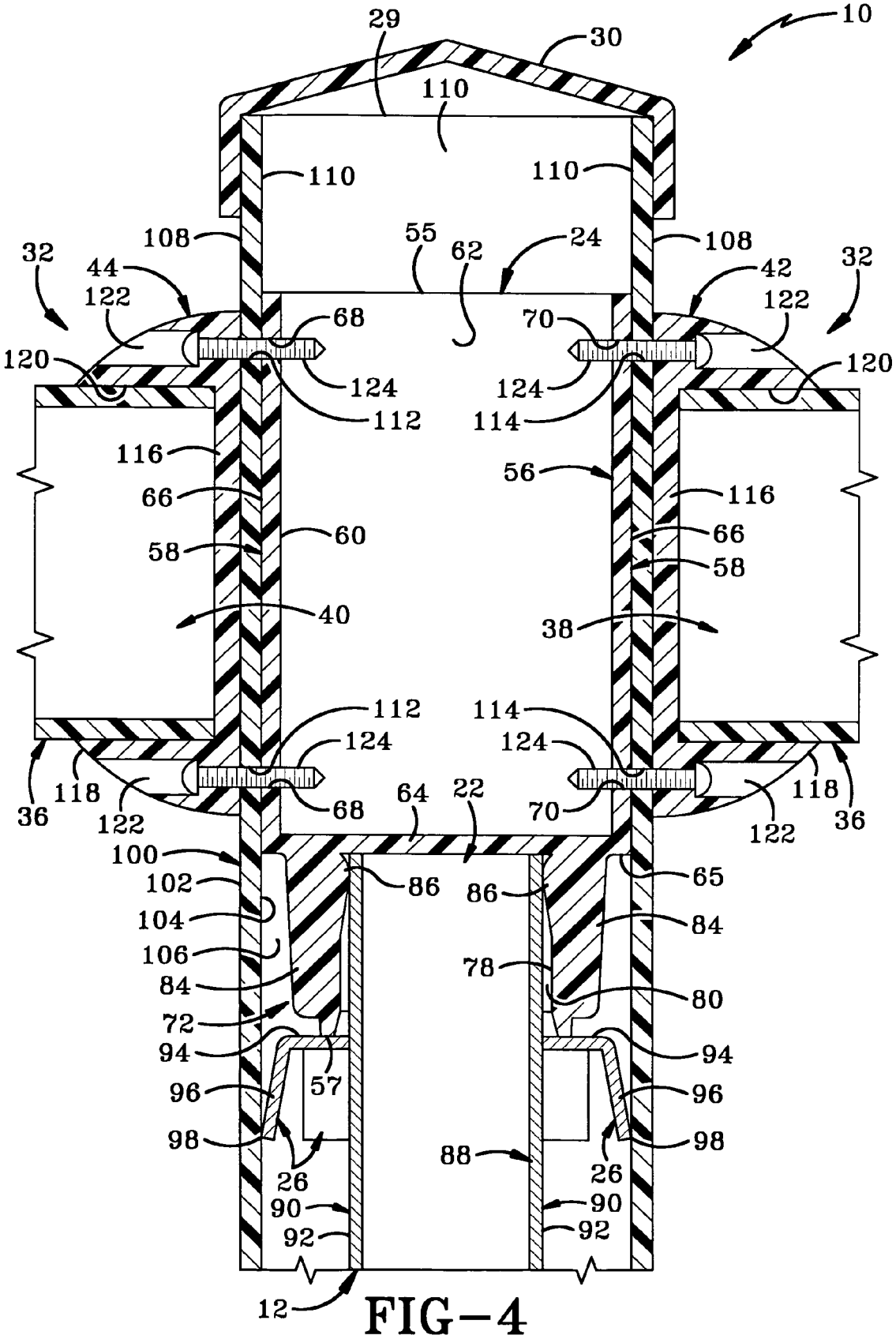
FIG. 4 is an enlarged fragmentary sectional view of a portion of FIG. 1 showing the first embodiment of the post insert in relation to the various other structures of the fence system.

With reference to FIGS. 2-4, post insert 24 is further detailed. Post insert 24 has an upper end 55 and a lower end 57 and is elongated therebetween, with lower end 57 being spaced upwardly a substantial distance (nearly that of height H1) from lower end 20 of post mount 12. Post insert 24 has a height H2 (FIG. 2) extending from upper end 55 to lower end 57. Height H1 (FIG. 1) of post mount 12 is over three times that of height H2 of post insert 24. Post insert 24 includes an upper sleeve or sidewall 56 having an outer surface 58 and an inner surface 60 (FIG. 4) defining an interior chamber or upwardly opening cavity 62. Upper sidewall 56 is substantially square as viewed from above or below although the shape may vary. Preferably however, sidewall 56 is non-circular in cross-section. Upper sidewall 56 extends upwardly from a separating wall 64 (FIG. 4) which serves as a base wall bounding the lower end of cavity 62. Upper sidewall 56 has a lower end 65 coincident with a lower surface of separating wall 64 and a height H3 (FIG. 2) extending from upper end 55 to lower end 65 which is approximately ¾ that of height H2 of post insert 24. Upper sidewall 56 includes four exterior flat portions 66 (FIGS. 2-3). Sidewall 56 defines a pair of holes 68 along one of the flat portions 66 and a second pair of holes 70 along opposed front portion 66 (FIG. 4). Holes 68 and 70 may be threaded if desired.

With continued reference to FIGS. 2-4, post insert 24 further includes a collar 72 extending downwardly from separating wall 64. Collar 72 includes a lower sidewall 74 which is substantially square in cross section and has an outer surface 76 and an inner surface 78 defining an interior chamber or downwardly opening cavity 80. Lower sidewall 74 is stepped inwardly from upper sidewall 56 at lower end 65 of sidewall 56 whereby outer surface 76 of lower sidewall 74 is disposed inwardly of outer surface 58 of upper sidewall 56. Lower sidewall 74 has a height H4 (FIG. 2) extending from lower end 65 of upper sidewall 56 to lower end 57 of post insert 24. Height H3 of upper sidewall 56 is approximately three times that of height H4 of lower sidewall 74. Lower sidewall 74 includes four substantially flat walls 82 with a respective projection or strengthening rib 84 extending outwardly from each flat wall 82 and formed integrally therewith. Each rib 84 extends from adjacent lower end 57 of post insert 24 to separating wall 64 to which rib 84 is connected and with which it is integrally formed. Collar 72 includes four projections 86 each of which extends inwardly from lower sidewall 74 and is integrally formed therewith, each projection 86 defining a portion of inner surface 78 and defining a portion of downwardly opening cavity 80. More particularly, each projection 86 extends inwardly from a respective flat wall 82 of sidewall 74. Projections 86 are disposed adjacent separating wall 64 which bounds an upper end of cavity 80.

With reference to FIG. 4, post mount 12 is further detailed. Post mount 12 is a hollow structure including a sidewall 88 which is substantially square in cross-section and has an outer surface 90. The square cross-sectional configuration provides for four exterior flat portions 92 (only two flat portions 92 are shown in FIG. 4). Post mount 12 adjacent upper end 22 thereof is slidably received within downwardly opening cavity 80 of post insert 24 so that upper end 22 abuts separating wall 64 of post insert 24. Thus, the lower surface of separating wall 64 is disposed a distance equal to height H1 (FIG. 1) from lower end 20 of post mount 12 when post insert 24 is mounted on post mount 12. In addition, outer surface 90 of sidewall 88 of post insert 24 engages inner surface 78 of lower sidewall 74 along projections 86. More particularly, each flat portion 92 of sidewall 88 is in frictional engagement with a respective inward projection 86.

With further reference to FIG. 4, each outward projection 26 mounted on post mount 12 includes an upper substantially horizontal leg 94 which extends outwardly from and is connected to post mount 12 adjacent and spaced downwardly from upper end 22. A tab 96 angles downwardly and outwardly from and is connected to leg 94, each tab 96 having an outermost edge 98. Lower end 57 of post insert 24 is seated atop an upper surface of leg 94 of each outward projection 26.

With continued reference to FIG. 4, post 28 has a sidewall 100 which is substantially square in cross-section and is elongated between upper end 29 and lower end 31 (FIG. 1). Sidewall 100 has an outer surface 102 and an inner surface 104 defining an interior chamber or cavity 106 which opens upwardly adjacent upper end 29 and opens downwardly adjacent lower end 31. Outer surface 102 of sidewall 100 includes four flat exterior surfaces 108, two of which are shown in FIG. 4. Inner surface 104 of sidewall 100 includes four interior flat surfaces 110, three of which are shown in FIG. 4. Sidewall 100 defines a pair of holes 112 extending from one exterior flat surface 108 to a corresponding interior flat surface 110 whereby holes 112 are aligned with respective holes 68 in post insert 24. Sidewall 100 also defines a pair of holes 114 extending from another exterior flat surface 108 to a corresponding interior flat surface 110, the latter of said flat surfaces 108 and 110 being on the opposite side of post 28 from holes 112. Holes 114 are aligned respectively with holes 70 in post insert 24. Holes 68, 70, 112 and 114 are all disposed upwardly of upper end 22 of post mount 12.

When assembled (FIG. 4), post insert 24, post mount 12 and outward projections 26 are slidably received within cavity 106 of post 28. Outermost edges 98 of tabs 96 of projections 26 are in frictional engagement with respective interior flat surfaces 110 of sidewall 100 of post 28. Post insert 24 is positioned within cavity 106 of post 28 so that upper end 55 of post mount 24 is adjacent upper end 29 of post 28. In addition, outer surface 58 of post insert 24 is disposed closely adjacent or in contact with inner surface 104 of post 28. In particular, each flat portion 66 of post insert 24 is closely adjacent or in contact with a respective interior flat surface 110 of post 28. More particularly, outer surface 58 is closely adjacent inner surface 104 of post 28 adjacent upper end 55 and lower end 65 of sidewall 56. Preferably, outer surface 58 of sidewall 56 is in its entirety closely adjacent inner surface 104 of post 28.

With continued reference to FIG. 4, rail mounting bracket 42 includes a base wall 116 and a collar 118 extending outwardly therefrom to define a cavity 120 in which first end 38 of one rail 36 is slidably received with first end 38 closely adjacent or in contact with base wall 116. Collar 118 and base wall 116 of bracket 42 further define a pair of counterbore holes 122 which are aligned with respective holes 114 in post 28 and 70 in post insert 24. A pair of fasteners in the form of threaded screws 124 are each inserted via one of counterbore holes 122 through respective holes 114 and 70, with each screw 124 threadably engaging hole 70 to secure rail mounting bracket 42 to post insert 24 with a portion of sidewall 100 of post 28 sandwiched therebetween, thereby mounting upper rail structure 32 to post 28 and post mount 12.

Thus, in accordance with a feature of the invention, rail mounting bracket 42 is connected to post insert 24 as opposed to being connected solely to post 28, thereby providing a substantially sturdier connection. In addition, because upper sidewall 56 of post insert 24 extends upwardly of upper end 22 of post mount 12, rail mounting bracket 42 is disposed upwardly of upper end 22 of post mount 12. Indeed, bracket 42 is disposed entirely above upper end 22 of post mount 12 whereby first end 38 of rail 36 is also disposed entirely above upper end 22. Since each rail 36 is substantially straight and substantially horizontal, each rail 36 therefore is disposed entirely above upper end 22 of post 12 so that the entire rail structure 32 is disposed entirely above upper end 22 of post 12. Rail mounting bracket 44 has the same configuration as rail mounting bracket 42 or is a mirror image thereof, is numbered similarly and mounted as described with regard to bracket 42. Thus, second end 40 of second rail 36 is received in cavity 120 of mounting bracket 44 with second end 40 disposed closely adjacent or in contact with base wall 116 of bracket 44. Similar to bracket 42, rail mounting bracket 44 is secured to post insert 24 by a pair of threaded screws 124 extending via respective counterbore holes 122 through respective holes 112 and 68 with each screw 124 threadably engaging hole 68. Cap member 30 is seated atop post 28 to protect the hollow interior chamber 106 thereof from the elements and provide preferred aesthetics.

Figure 5:
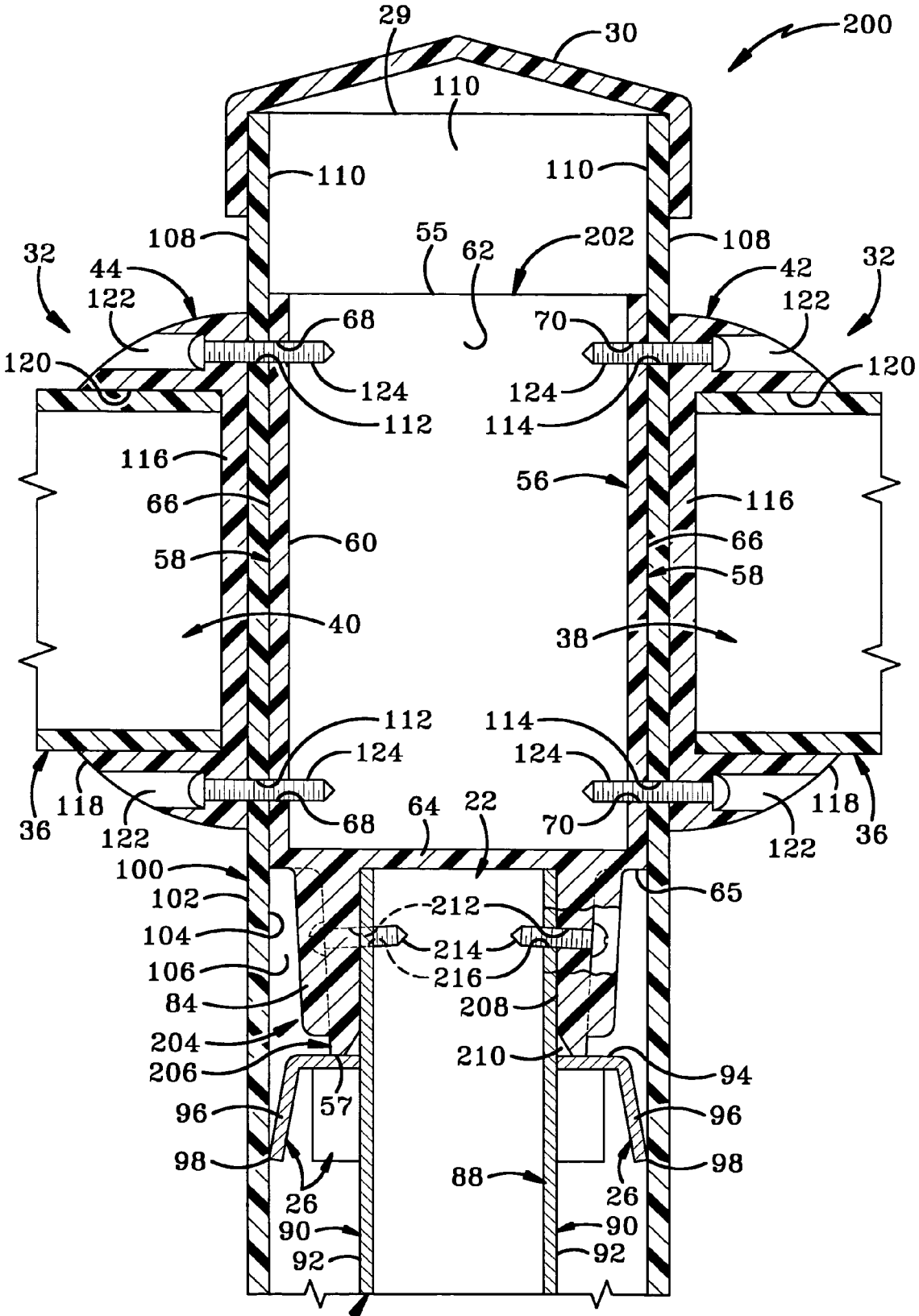
FIG. 5 is similar to FIG. 4 and shows a second embodiment of the post insert of the present invention.

With reference to FIG. 5, fencing system 200 is described. System 200 is similar to system 10 except that it has a post insert 202 which is slightly different than that of post insert 24 of system 10. In particular, post insert 202 is similar to post insert 24 except with regard to a collar 204 which differs from collar 72 of post insert 24. Collar 204 is free of inward projections such as projections 86 of post insert 24. Thus, collar 204 includes a lower sidewall 206 having a substantially square inner surface 208 which is in mating configuration to outer surface 90 of post mount 12 along virtually the entire length of the portion of post mount 12 adjacent upper end 22 thereof which is slidably received within a downwardly opening cavity 210 defined by inner surface 208 of collar 204. In addition, collar 204 defines a plurality of holes as at 212 through which respective fasteners in the form of threaded screws 214 extend and threadably engage holes 216 (which may or may not be threaded) formed in post mount 12 adjacent upper end 22 thereof to further secure post insert 202 to post mount 12. Screws 214 are optional and may be used in the first embodiment as well if desired.

Thus, fencing systems 10 and 200 provide a sturdier mounting system than is known of in the prior art. In particular, post insert 24 provides a sturdier mounting structure to which upper rail structure 32 may be mounted. In particular, post inserts 24 and 202 each provide a structure other than the post itself to which the rail structures or rail mounting brackets are directly secured. Further, outer surface 58 of post insert 24 provides a substantial surface area which is disposed closely adjacent or in contact with inner surface 104 of post 28, thus providing greater stability or sturdiness via a surface area which is larger than in known prior art as well as a substantial area which is closely adjacent or in abutment with the inner surface of the post. Post insert 24 or 202 is also firmly mounted atop post mount 12 as previously described with engagement with post mount 12 and inward projections 86 of post insert 24 or the elongated inner surface 208 of post insert 202. In addition, lower end 57 of post insert 24 or 202 abuts legs 94 of projections 26 to enhance the stable mounting of post inserts 24 and 202. Fasteners such as screws 214 may also increase this stability. Moreover, post mounts 24 and 202 extend primarily upwardly of upper end 22 of post mount 12, thereby allowing post mount 12 to be shorter while the post mount provides sufficient height for mounting of the rail structure.

It will be evident to one skilled in the art that a variety of changes could be made to present embodiments described which are within the scope of the present invention. For example, as previously mentioned or implied, the cross-sectional shapes of the post, the post insert and the post mount may take on a variety of shapes other than square while still being within the scope of the present invention. As previously noted, preferably these cross-sectional shapes are non-circular in order to facilitate the alignment of the various pieces and related holes and fasteners. In addition, it is preferred that the cross-sectional shape of the outer surface of the post insert upper sidewall is substantially the same as that of the inner surface of the post. It is also preferred that this be the case for the outer surface of the post mount and the inner surface of the lower sidewall of the post insert in the area where they engage one another.

Most typically, post mount 12 is formed of a metal or metal alloy to provide the desired strength, although this may vary for certain applications. Most typically, the post mounts are formed of an extrudable shape to keep costs lower. Similarly, the posts and rails are most preferably formed of extrudable materials and shapes. Most commonly, the rails, rail mounting brackets, post and post insert will be formed of a sturdy plastic material, although again this may vary in accordance with the application.

In addition, rail structures 36 and 46 are shown in the drawings as being formed from more than one piece, namely a rail 36 and rail mounting bracket 42 or 44. Such a configuration allows the rail to be extrudable as previously noted. However, it is contemplated that the rail structure may be a one-piece member which may be formed integrally and has suitable flanges or other structure suitable for mounting to the post insert. Most preferably, the rail structures are mounted to the post insert via fasteners which extend through holes as described and most preferably involve a threaded engagement between the fastener and the post insert. However, other types of suitable fasteners may be used to secure the rail structure to the post insert. For example, fasteners which extend through holes analogous to those described herein and which engage a second fastening member such as a nut may be used. Although this type fastener may require additional effort during assembly, the upwardly opening cavity of the post insert provides access from above to permit the use of these types of fasteners.

In addition, the collars of the post inserts as described herein define a cavity which slidably receives an upper end of the post mount in order to mount the post insert atop the post mount. However, it is contemplated that the first insert may be mounted with a downwardly extended projection which is inserted into the hollow interior of the post mount. However, a collar or similar structure disposed outwardly in the post mount is preferred to provide greater stability. Further, outward projections such as projections 26 which extend from the post mount may be eliminated although they provide additional support to the post insert as well as the post. The specific heights detailed herein may vary. However, the heights which are specified represent typical relationships between various structures of which those heights are given. Other changes within the scope of the invention will be evident to one skilled in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A fencing system comprising:

a post mount having an upper end, a lower end and an outer surface extending therebetween; the post mount being adapted to be mounted adjacent the lower end thereof to a foundation;

an upwardly facing surface on the upper end of the post mount; the upwardly facing surface serving as an uppermost surface of the post mount;

a post insert having an upper end, a lower end and an outer surface which extends therebetween;

an upper sidewall on the post insert defining an upwardly opening cavity above the upper end of the post mount and comprising a portion of the outer surface of the post insert which is disposed outwardly of the outer surface of the post mount and above the upper end of the post mount; the post insert being mounted on the post mount adjacent the upper end of the post mount;

a first wall on the post insert disposed directly above and abutting the upwardly facing surface on the upper end of the post mount;

a structural member having an inner surface defining a cavity in an end thereof; the post mount and post insert being slidably received in the cavity of the structural member with the portion of the outer surface of the post insert abutting the inner surface above the upper end of the post mount; and a rail structure secured to the structural member.

2. The system of claim 1 wherein the rail structure includes a rail mounting bracket which is secured to the post insert.

3. The system of claim 2 wherein the rail structure includes a rail having a pair of opposed ends; and wherein the rail is mounted adjacent one end thereof to the rail mounting bracket.

4. The system of claim 3 wherein the one end of the rail is disposed at least partially above the upper end of the post mount.

5. The system of claim 1 wherein the rail structure is secured to the upper sidewall.

6. The system of claim 1 wherein at least one fastener extends from the rail structure to the post insert to secure them together.

7. The system of claim 6 wherein the post insert defines at least one hole; wherein the structural member defines at least one hole aligned with the at least one hole of the post insert; and wherein the at least one fastener extends from the rail structure through the at least one hole of the structural member and into the at least one hole of the post insert.

8. The system of claim 7 wherein the holes of the structural member and post insert are disposed upwardly of the upper end of the post mount.

9. The system of claim 7 wherein the fastener is threadably received in the at least one hole in the post insert to secure the rail structure to the post insert.

10. The system of claim 1 wherein the post insert is distal the lower end of the post mount.

11. The system of claim 10 wherein the structural member has an upper end and a lower end disposed adjacent the lower end of the post mount; and wherein the upper end of the post insert is disposed adjacent the upper end of the structural member.

12. The system of claim 1 wherein the structural member includes an inner surface defining the cavity therein; and wherein the outer surface of the post insert and the inner surface of the structural member have a complementary shape.

13. The system of claim 1 wherein the post insert is mounted on the post mount via a frictional engagement between the post insert and the post mount.

14. The system of claim 13 wherein one of the post insert and the post mount defines a cavity in which a portion of the other of the post insert and the post mount is received to form the frictional engagement.

15. The system of claim 14 wherein the post insert defines a downwardly opening cavity in which the upper end of the post mount is received to form the frictional engagement; wherein the upwardly opening cavity is disposed above the downwardly opening cavity; and wherein the first wall separates the two cavities from one another.

16. The system of claim 15 wherein the upper sidewall extends upwardly from the first wall; wherein a lower sidewall extends downwardly from the first wall and defines the downwardly opening cavity; and wherein a plurality of strengthening ribs extend outwardly from the lower sidewall.

17. The system of claim 15 wherein the upper sidewall extends upwardly from the first wall; wherein a lower sidewall extends downwardly from the first wall and defines the downwardly opening cavity; and wherein a plurality of projections extend inwardly from the lower sidewall and frictionally engage the post mount.

18. The system of claim 15 wherein the upper sidewall extends upwardly from the first wall; wherein a lower sidewall which is disposed inwardly of the upper sidewall extends downwardly from the first wall and defines the downwardly opening cavity.

19. The system of claim 1 wherein the structural member has an inner surface defining the cavity therein; and wherein a plurality of projections extend outwardly from the post mount and frictionally engage the inner surface of the structural member.

20. The system of claim 19 wherein the lower end of the post insert contacts the projections extending from the post mount.

21. The system of claim 1 wherein the first wall is seated atop the upwardly facing surface on the upper end of the post mount in abutment therewith to serve as a stop which limits downward movement of the post insert relative to the post mount.

22. The system of claim 1 further comprising a downwardly opening cavity formed in the post insert which receives therein the upper end of the post mount and is bounded by the first wall.

23. The system of claim 22 wherein the upwardly opening cavity is disposed above the downwardly opening cavity and is bounded by the first wall.

24. A fencing system comprising:

a post mount having an upper end, a lower end and an outer surface extending therebetween; the post mount being adapted to be mounted adjacent the lower end thereof to a foundation; the upwardly facing surface serving as an uppermost surface of the post mount;

a post insert having an upper end, a lower end and an outer surface which extends therebetween wherein a portion of the outer surface of the post insert is disposed outwardly of the outer surface of the post mount; the post insert being mounted on the post mount adjacent the upper end of the post mount;

an upwardly facing surface on the upper end of the post mount;

a stop on the post insert abutting the upwardly facing surface on the upper end of the post mount to limit downward movement of the post insert relative to the post mount;

a structural member defining a cavity in an end thereof; the post mount and post insert being slidably received in the cavity of the structural member; and a rail mounting bracket which is secured to the post insert, has upper and lower ends, and is adapted for mounting a rail on the structural member;

at least one fastener extending from the mounting bracket to the post insert to secure the bracket and post insert together.

25. The system of claim 24 wherein the rail mounting bracket is disposed entirely above the upper end of the post mount.

26. A fencing system comprising: a post mount which has an upper end, a lower end, an outer surface extending therebetween and an upwardly facing surface on the upper end and which is adapted to be mounted adjacent the lower end thereof to a foundation; the upwardly facing surface serving as an uppermost surface of the post mount; a structural member having an inner surface defining a cavity in an end of the structural member; the post mount being slidably received in the cavity of the structural member with the inner surface of the structural member spaced outwardly from the outer surface of the post mount; a rail structure secured to the structural member; and a the post insert comprising:

a lower sidewall having an inner surface adapted to frictionally engaging the outer surface of the post mount;

a laterally extending wall which extends inwardly of the inner surface of the lower sidewall and extends directly over and abuts the upwardly facing surface on the upper end of the post mount whereby the post insert is mounted on the post mount adjacent its upper end; and an upper sidewall having an outer surface which extends upwardly of the laterally extending wall, is disposed outwardly of the lower sidewall, and abuts the inner surface of the structural member above the upper end of the post mount; the rail structure mounted on the upper sidewall so that the rail structure is secured to the structural member.

27. The system of claim 26 wherein the laterally extending wall is seated atop the upwardly facing surface of the upper end of the post mount in abutment therewith to serve as a stop to limit downward movement of the cost insert relative to the post mount.

28. The system of claim 26 further comprising a downwardly opening cavity bounded by the inner surface of the lower sidewall and receiving therein the upper end of the post mount; and first and second opposed sides on the inner surface of the lower sidewall disposed on opposed sides of the outer surface of the post mount; and wherein the laterally extending wall is connected to and extends between the first opposed side and the second opposed side.

29. The system of claim 26 wherein the inner surface of the lower sidewall comprises a plurality of a substantially flat upwardly extending inner surfaces bounding a downwardly opening cavity receiving therein the upper end of the post mount with the substantially flat surfaces engaging the outer surface of the post mount; and the laterally extending wall extends from one of the substantially flat inner surfaces to another of the substantially flat inner surfaces.

30. The system of claim 29 wherein the plurality of substantially flat inner surfaces comprises four substantially flat inner surfaces; and wherein the laterally extending wall is connected to and extends inwardly from each of the four substantially flat inner surfaces.

31. The system of claim 26 further comprising at least one fastener extending outwardly from the outer surface of the upper sidewall to connect the rail structure and structural member to the post insert.

32. A post insert for use with a fencing system comprising: a post mount which has an upper end, a lower end, an outer surface extending therebetween and an upwardly facing surface on the upper end; the upwardly facing surface serving as an uppermost surface of the post mount; the post mount adapted to be mounted adjacent its lower end to a foundation; a structural member having an inner surface defining a cavity in an end of the structural member; the post mount being slidably received in the cavity of the structural member with the inner surface of the structural member spaced outwardly from the outer surface of the post mount; a rail structure secured to the structural member; and a the post insert comprising:

a body having upper and lower ends, an outer surface extending therebetween and an inner surface;

a portion of the outer surface disposed outwardly of the inner surface of the body and abutting the inner surface of the structural member;

a downwardly opening cavity formed in the body extending upwardly from its lower end, bounded by its inner surface and receiving therein the upper end of the post mount with the inner surface of the body engaging the outer surface of the post mount;

a stop on the body extending inwardly from its inner surface above the downwardly opening cavity and abutting the upwardly facing surface on the upper end of the post mount to limit downward movement of the post insert relative to the post mount whereby the post insert is mounted on the upper end of the post mount; and at least one fastener extending outwardly from the outer surface of the body to connect the rail structure and structural member to the post insert.

* * * * *

UNITED STATES PATENT AND TRADEMARK OFFICE

CERTIFICATE OF CORRECTION

PATENT NO. : 7,407,152 B2
APPLICATION NO. : 11/046499
DATED : August 5, 2008
INVENTOR(S) : Platt It is certified that error appears in the above-identified patent and that said Letters Patent is hereby corrected as shown below:

Column 9, line 42 change “cost” to “post” -- to limit downward movement of the post insert relative to the --

Signed and Sealed this

Sixteenth Day of June, 2009

JOHN DOLL
*Acting Director of the United States Patent and Trademark Office*